US007740512B1

(12) United States Patent
Patterson

(10) Patent No.: US 7,740,512 B1
(45) Date of Patent: Jun. 22, 2010

(54) METHOD AND APPARATUS FOR CATCHING WAVES UTILIZING A DISENGAGEABLE SURFBOARD

(76) Inventor: Shaun Patterson, 1113 Callado St., Camarillo, CA (US) 93010

( * ) Notice: Subject to any disclaimer, the term of this patent is extended or adjusted under 35 U.S.C. 154(b) by 240 days.

(21) Appl. No.: 12/072,026

(22) Filed: Feb. 21, 2008

(51) Int. Cl.
*A63C 5/03* (2006.01)

(52) U.S. Cl. ..... 441/74

(58) Field of Classification Search ..... 441/65, 441/74, 75; 114/357
See application file for complete search history.

(56) References Cited

U.S. PATENT DOCUMENTS 3,996,868 A * 12/1976 Schagen ..... 114/39.14
5,711,692 A * 1/1998 Pope ..... 441/74
5,957,741 A * 9/1999 Evans ..... 441/75
6,623,323 B1 * 9/2003 Mead ..... 441/74
6,656,005 B2 12/2003 Meyerhoffer
7,121,909 B1 10/2006 Meyerhoffer
2003/0199213 A1 10/2003 Meyerhoffer
2006/0189228 A1 8/2006 Murphy et al.
2006/0246795 A1 11/2006 Meyerhoffer

* cited by examiner

*Primary Examiner*—Stephen Avila
(74) *Attorney, Agent, or Firm*—Sandy Lipkin

(57) ABSTRACT

A disengageable surfboard that starts out as a long, paddle-sized board that a surfer uses, either in the standard prone position or standing with a paddle, to enter the surf. Once the surfer has used the board to catch a wave, he or she quickly releases the back portion of the board, typically made of a soft foam, through a quick move of his or her foot, leaving the surfer with a smaller, higher performance surfboard that would have been initially difficult for the surfer to catch without the extra length afforded through the disengaged piece.

9 Claims, 12 Drawing Sheets

METHOD AND APPARATUS FOR CATCHING WAVES UTILIZING A DISENGAGEABLE SURFBOARD

BACKGROUND OF THE INVENTION

1. Field of the Invention

The field of this invention relates generally to the field of surfboards and particularly to a composite, two piece board that can disengage from a large paddle board sized board into a smaller, high-performance surfboard once in the surf.

2. Description of the Prior Art

Surfing and all modes of wave catching have been popular endeavors for decades. A person wishing to catch a ride on a breaking wave can paddle into the waves on his or her stomach, paddle into and catch the wave, and then stand up and ride the moving wave. This is typically accomplished with a surfboard, of varying lengths and shapes, made of polyurethane or expanded polystyrene foam that is covered with layers of fiberglass cloth and polyester or epoxy resin. Boogie boards are another popular way to catch waves, which are smaller, square-shaped and made of foam. Boogie boards generally are too small to allow for standing up once in the wave, but do provide a means for catching a wave with a short board that is made of soft material.

Additionally wave riding tools include kayaks, which can catch waves through the use of paddles while the rider is seated in a kayak. Also, kneeboarders can catch waves and only rise as high as their knees rather than their feet for deeper riding in the wave. With regard to paddling into the surf, the physical stamina required diminishes as he or she ages. Stand-up paddle boards have recently been added to the equipment for wave riding, particularly for those whose upper body strength and stamina are on the wane due to age.

As experienced and accomplished surfers know, the highest performance offered when surfing is given by a short board. As aging surfers also know, paddling into and catching a wave with a short board requires the sort of physical ability not often seen in those over the age of forty.

Accordingly, there exists a need for the aging or otherwise enfeebled surfer (through injury and the like) to catch a wave and still be able to enjoy the sort of ride that is offered by a short board. The instant invention offers a long board, which is generally defined as a board between nine and twelve feet long, that can be used either lying prone or with a paddle to catch the wave, but that can be converted into a smaller board once standing on the wave in the water through a quick release action using the surfer's foot to release the excess of the board that was required to catch the wave. This excess material is made of the same sort of soft foam used in the manufacture of boogie boards.

Heretofore, there has not been a board that can be used to catch and ride waves that breaks apart in the water so as to offer the surfer the ability to ride a short board. Prior art in the field has included surfboards that can break into more than one piece, but these inventions require assembly and disassembly while outside of the water and are primarily designed to provide the ability to change the size and shape of the board on the beach, prior to paddling out, depending upon surf conditions or that provide for the breakdown of the board into smaller pieces for ease of travel. Some examples of these types of boards can be found U.S. Pat. Nos. 7,121,909 and 6,656,005.

SUMMARY OF THE INVENTION

It is the object of the instant invention to provide for a disengageable wave-riding board that affords the user the advantages of a longer board in order to catch a wave at its earliest point while subsequently allowing the wave rider to separate the long board into two parts with a swift move of his or her foot, in the water, thereby leaving a higher performance short board left to the wave rider to ride.

The basic embodiment of the present invention teaches a long board that can break apart in the water to provide a shorter board to ride comprising a base board having a top platform, two side rails, a tail, a bottom side, at least one fin on the bottom side, and a connecting portion at the opposite of the tail; a front board that is releasably connected to the base at the connecting portion, the front board having a top platform, a nose, a tail, two side rails, a bottom side and at least one fin on the bottom side; wherein the front board is connected to the base board at the connecting portion and wherein the front board is easily released from the base board through the application of pressure to the connecting portion.

The above embodiment can be further modified by defining that the base board is made of foam.

The above embodiment can be further modified by defining that the front board is made of polyurethane covered with layers of fiberglass cloth and polyester.

The above embodiment can be further modified by defining that the front board is made of polyurethane covered with layers of fiberglass cloth and epoxy resin.

The above embodiment can be further modified by defining that the front board is made of expanded polystyrene foam covered with layers of fiberglass cloth and polyester.

The above embodiment can be further modified by defining that the front board is made of expanded polystyrene foam covered with layers of fiberglass cloth and epoxy resin.

The above embodiment can be further modified by defining that the front board further comprises a means for securing a tether that has a proximate end attached to the front board and a distal end attached to the user's body.

A second embodiment of the instant invention teaches a method of catching and riding waves comprising paddling a long board that can break apart in the water to provide a shorter board into the surf, the long board further comprising a base board having a top platform, two side rails, a tail, a bottom side, at least one fin on the bottom side, and a connecting portion at the opposite of the tail; a front board that is releasably connected to the base at the connecting portion, the front board having a top platform, a nose, a tail, two side rails, a bottom side and at least one fin on the bottom side; wherein the front board is connected to the base board at the connecting portion and wherein the front board is easily released from the base board through the application of pressure to the connecting portion; turning the long board toward the shore and paddling with the wave until the board is moving toward the shore along the wave; jumping to a standing position on the top platform of the base board; moving to the top platform of the front board; applying pressure to the connecting portion of the base board thereby releasing the front board from the base board; and continuing to ride the wave with the front board alone.

The above embodiment can be further modified by defining that the long board is paddled into the surf with the user in a standing position and using a paddle.

The above embodiment can be further modified by defining that the long board is paddled into the surf with the user in the prone position and using his arms.

The above embodiment can be further modified by defining that the base board is made of foam.

The above embodiment can be further modified by defining that the front board is made of polyurethane covered with layers of fiberglass cloth and polyester.

The above embodiment can be further modified by defining that the front board is made of polyurethane covered with layers of fiberglass cloth and epoxy resin.

The above embodiment can be further modified by defining that the front board is made of expanded polystyrene foam covered with layers of fiberglass cloth and polyester.

The above embodiment can be further modified by defining that the front board is made of expanded polystyrene foam covered with layers of fiberglass cloth and epoxy resin.

The above embodiment can be further modified by defining that the front board further comprises a means for securing a tether that has a proximate end attached to the front board and a distal end attached to the user's body.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
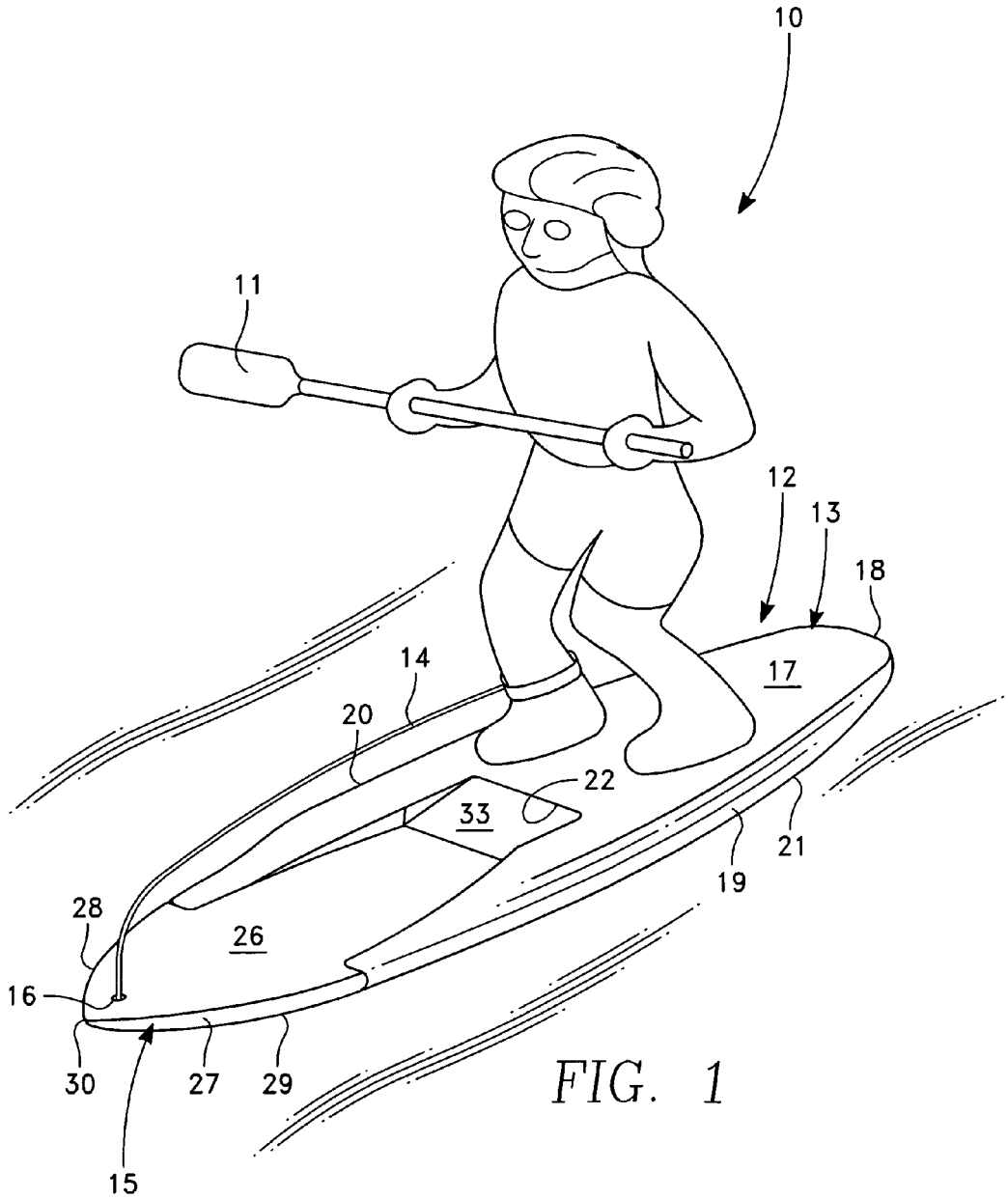
FIG. 1 is a perspective view of the invention used in the paddle-board embodiment to paddle into the surf.

Turning to the drawings, the preferred embodiment is illustrated and described by reference characters that denote similar elements throughout the several views of the instant invention.

The instant invention describes both an apparatus for catching and riding waves, but also the method of use. The embodiment shown in the drawings utilizes the method of paddling into the waves using the stand-up position and a paddle. It is to be understood that the board could also enter the surf with the rider being in the traditional prone position and paddling with his or her arms.

Figure 2:
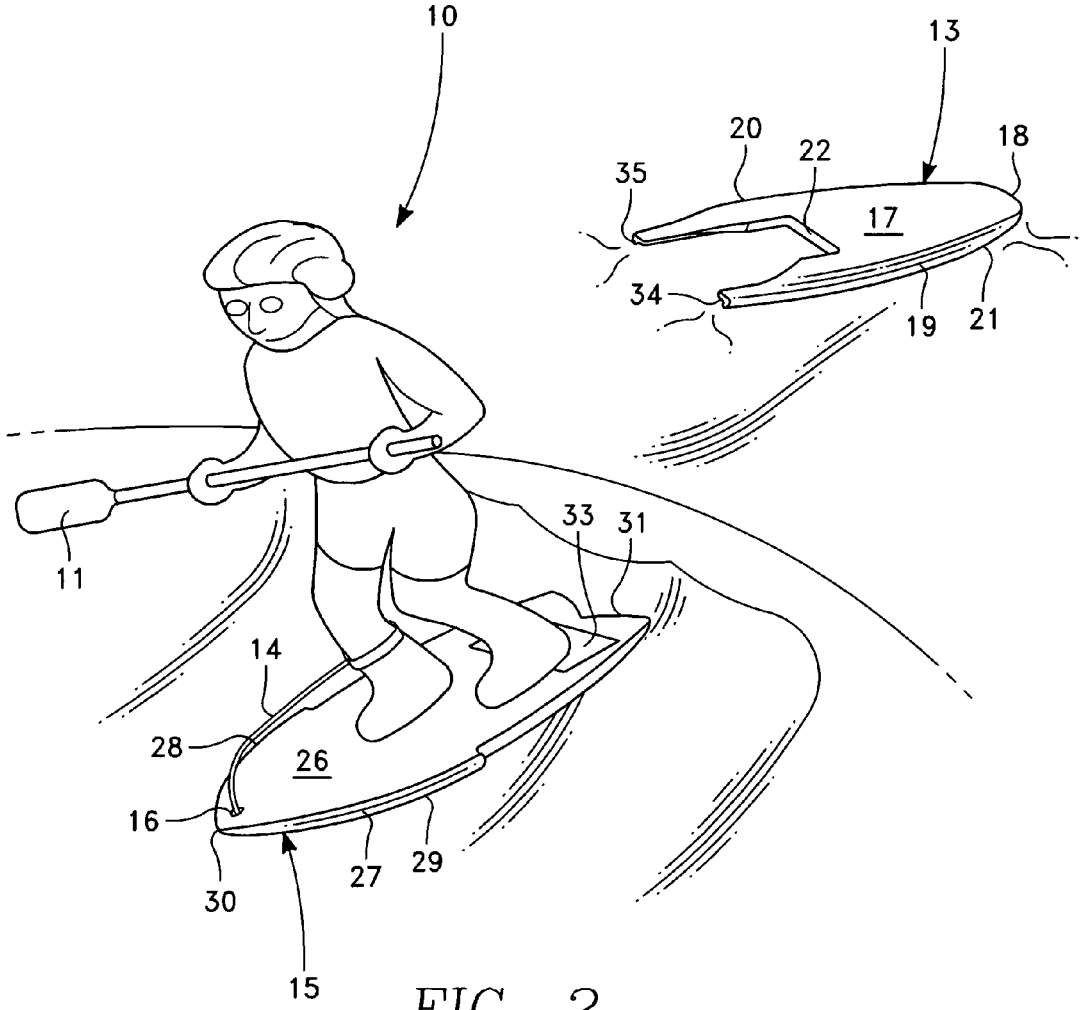
FIG. 2 is a perspective view of the invention after it has broken away to leave the surfer riding a shorter board.

FIG. 1 shows a rider 10 with a paddle 11 standing on the long board 12 of the instant invention. The rider 10 is standing on the base board 13 while a tether 14 keeps him connected to the front board 15 through a mounting mechanism 16. In FIG. 1, the rider 10 is shown on the long board 12 before the board 12 has been split in two pieces. In FIG. 2, the rider 10 has now caught a wave and disengaged the front board 15 from the base board 13.

Figure 3:
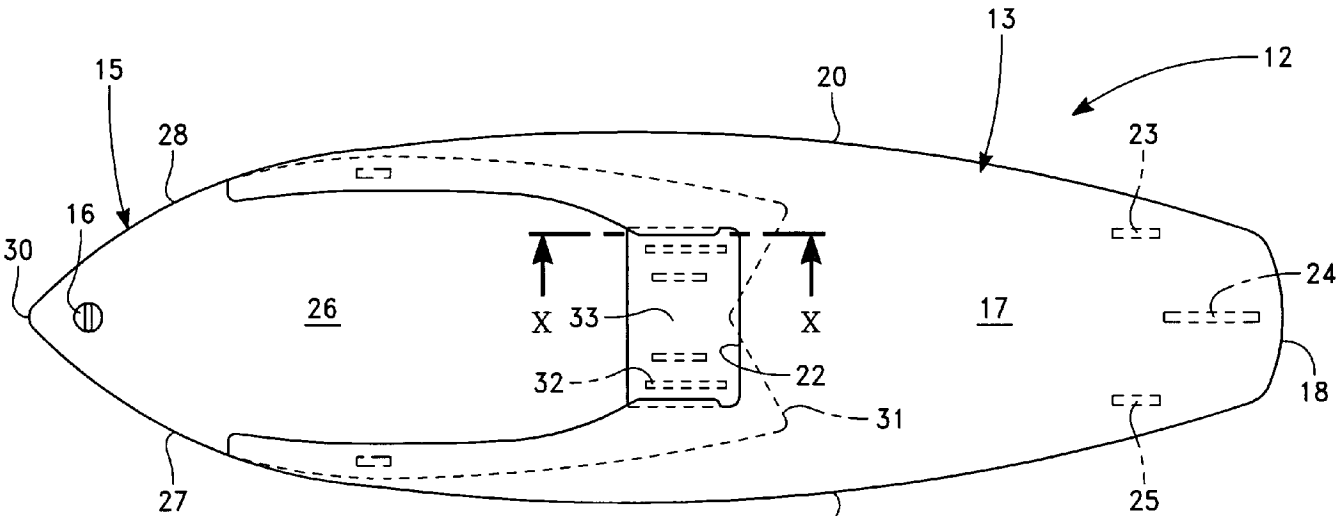
FIG. 3 is a top view of the board while still intact.
Figure 4:
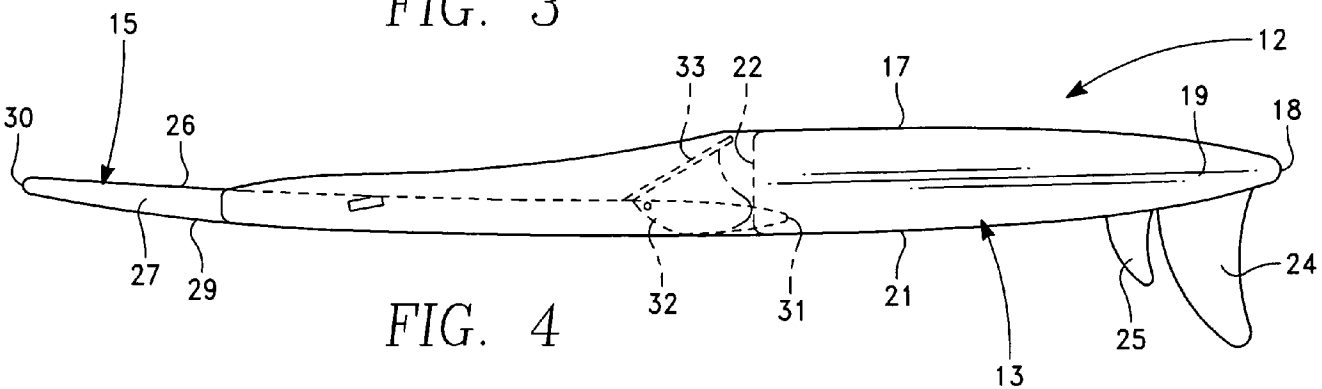
FIG. 4 is a side view of the board while still intact.
Figure 5:
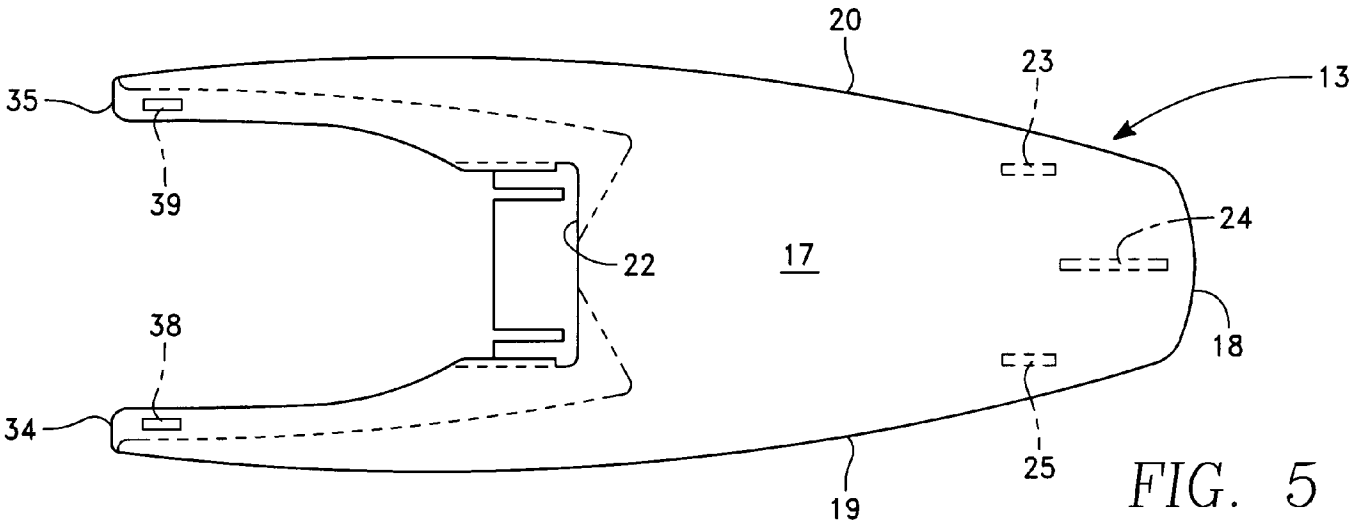
FIG. 5 is a top view of the broken away portion of the board.

The long board 12 of the invention is shown in top view in FIG. 3 and in a side view in FIG. 4. The long board 12 is composed of two smaller pieces that easily disengage with the application of pressure by the user 10 after catching a wave. The base board 13 sits on the rear of the long board 12 and has a top platform 17, a tail portion 18, two sidewalls 19, 20, a bottom portion 21, a connecting portion 22 and three fins 23, 24, 25 protruding from the bottom portion 21. The front board 15 is connected to the base board 13 at the connecting portion 22. It also has a top platform 25, two sidewalls 26, 27, a bottom portion 28, a nose 29, a tail 30 and at least one fin 31 protruding from the bottom portion 28.

As is visible in FIG. 4, the fin 31 of the front board 15 is tucked inside of the base board 13 at the connecting portion 22. The connecting portion includes a location 33 for the user 13 to depress his foot against at the time for release of the base board 13. Once the requisite amount of pressure is applied, approximately 50 pounds, the base board 13 is released in the water and the user 10 is left riding the front, smaller board 15.

Figure 6:
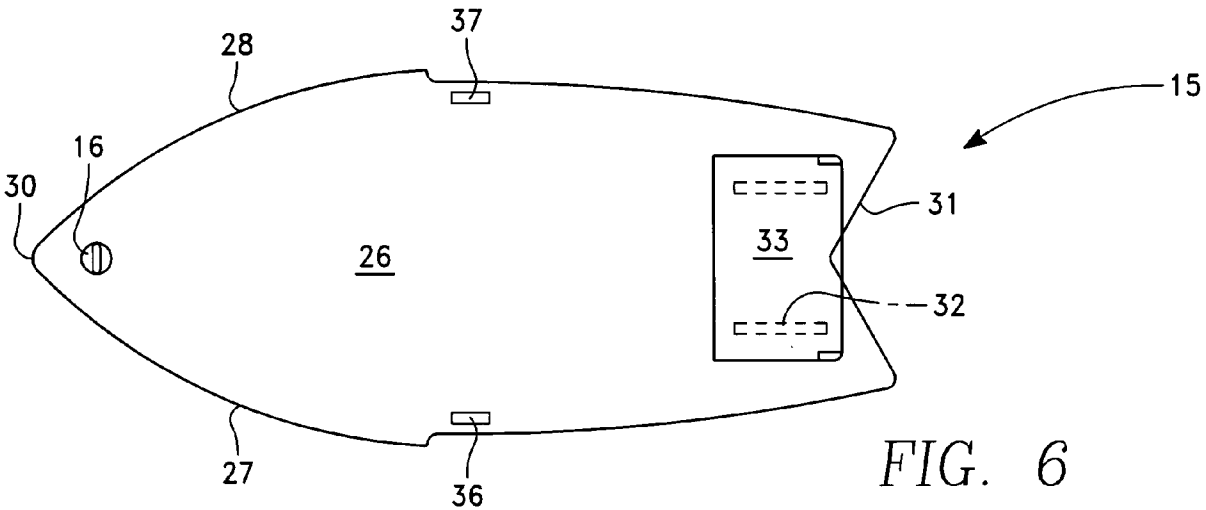
FIG. 6 is a top view of the short board portion of the board.

FIG. 6 shows the base board 13 after being disconnected from the long board 12. The sidewalls 19, 20 include channels 34, 35 that receive the front board 15 when the long board 12 is intact. Small depressions 36, 37 in the front board 16 interlock with flanges 38, 39 found on the sidewalls 19, 20 in the channels 34, 35 that connect with the depressions 36, 37 in the sidewalls 27, 28 of the front board 15. The precise orientation is not limited to this configuration, however. It is to be understood that the male member of the fitting can exist on either set of sidewalls as long as a corresponding female member is found on the opposite set of sidewalls.

Figure 7:
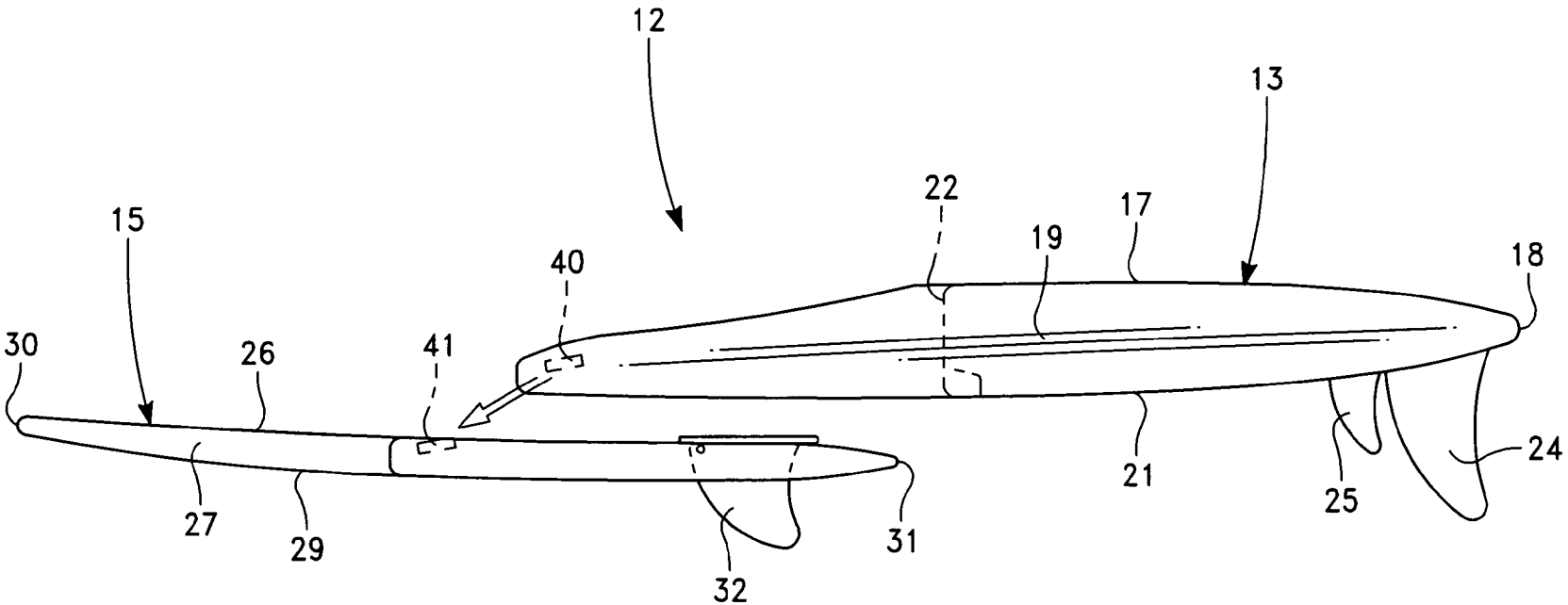
FIG. 7 is a side view of the board just as it has broken into two parts.
Figure 8:
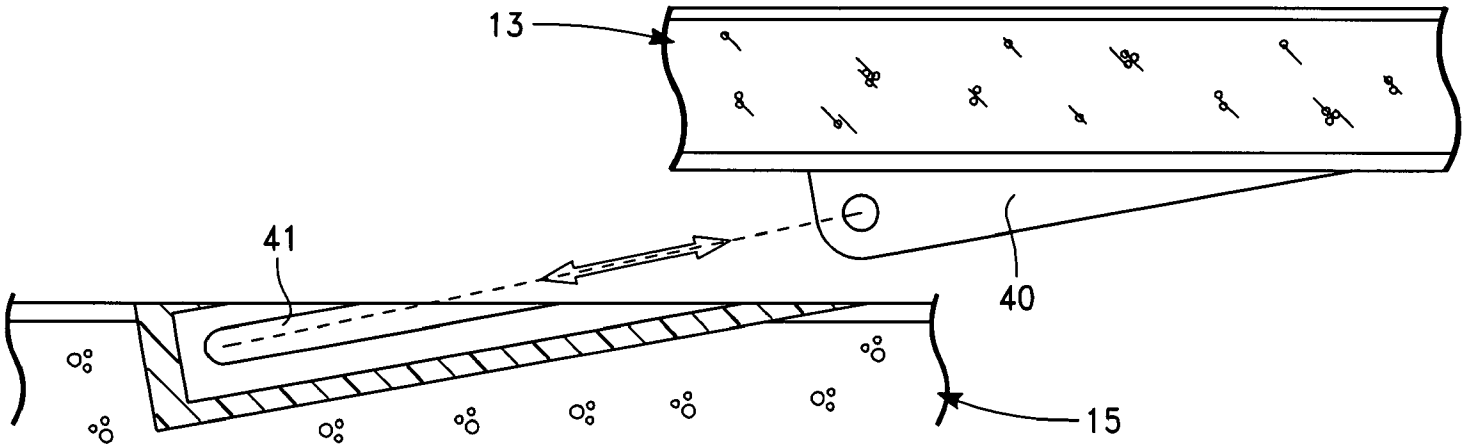
FIG. 8 is a close up view of the connecting portion of the two pieces while broken apart.
Figure 9:
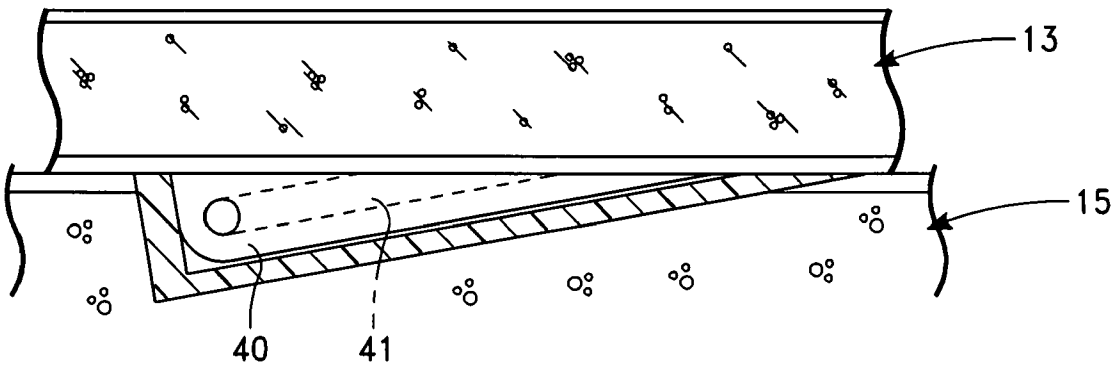
FIG. 9 is a close up view of the connecting portion of the two pieces while still intact.

FIG. 7 shows the directional mechanism for connecting the base board 13 to the front board 15. FIG. 8 is a close-up view of the near-connection shown in FIG. 7. A protruding member 40 from the bottom 21 of the base board 13 slides into a channel 41 found in the top platform 26 of the front board 15. FIG. 9 shows the base board 13 and the front board 15 intact using this mechanism.

Figure 10:
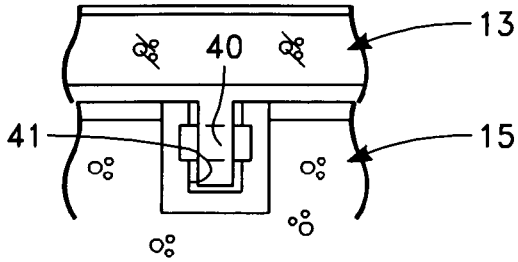
FIG. 10 is taken along the line 8-8 in FIG. 9.
Figure 11:
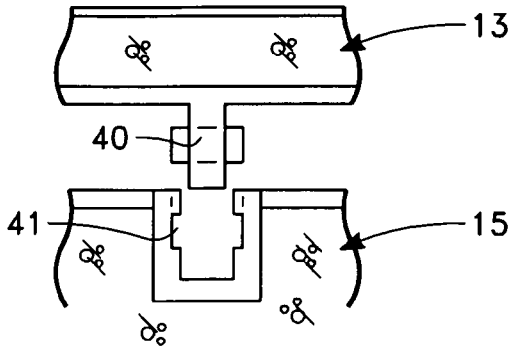
FIG. 11 is the same view as in FIG. 10, but with the two boards broken apart.
Figure 12:
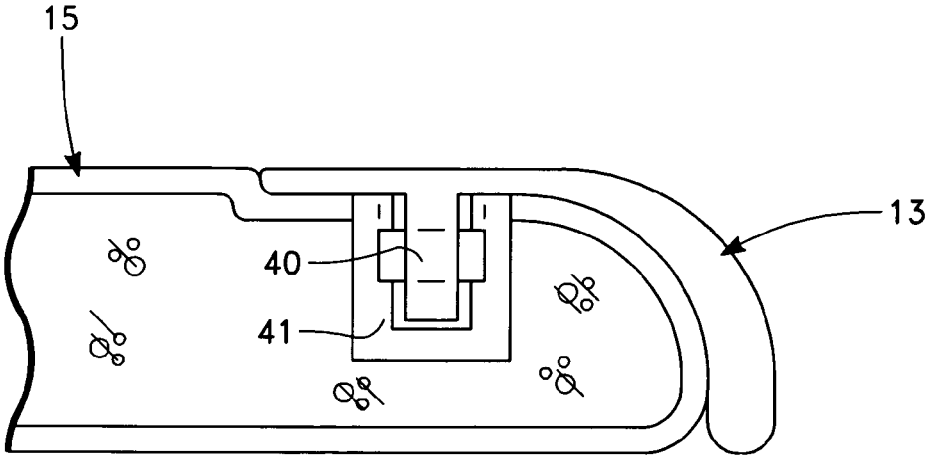
FIG. 12 is taken along the line 10-10 in FIG. 3.
Figure 13:
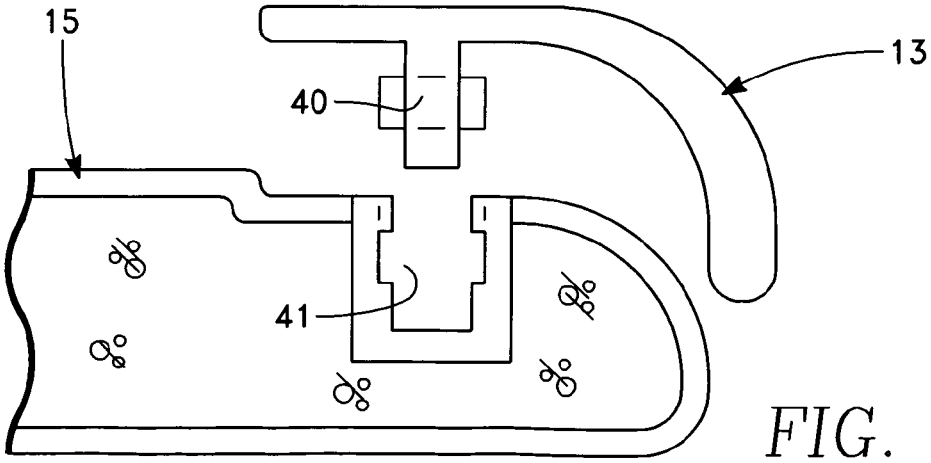
FIG. 13 is similar to the view in FIG. 12, but with the two boards being separated.

FIG. 10 shows the protruding member 40 snugly inside the channel 41 of the front board 15 while FIG. 11 shows the protruding member 41 as it is released from the channel 41 of the front board 15. Similarly, in FIG. 12, the base board 13 is shown snugly atop the front board 15 with the protrusion 40 locked into the channel 41 of the front board and FIG. 13 shows the same thing, but with the two boards separated.

Figure 14:
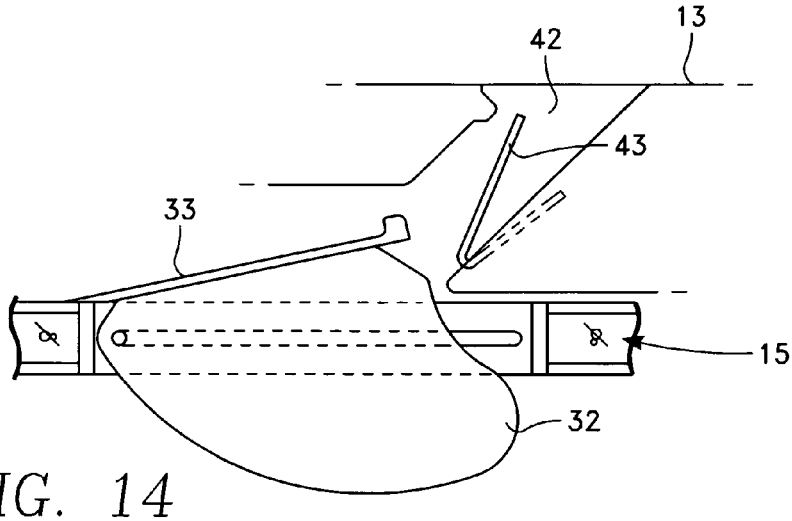
FIG. 14 is a side view of the two halves of the board separated and how the fin of the short board fits into the disengageable half.
Figure 15:
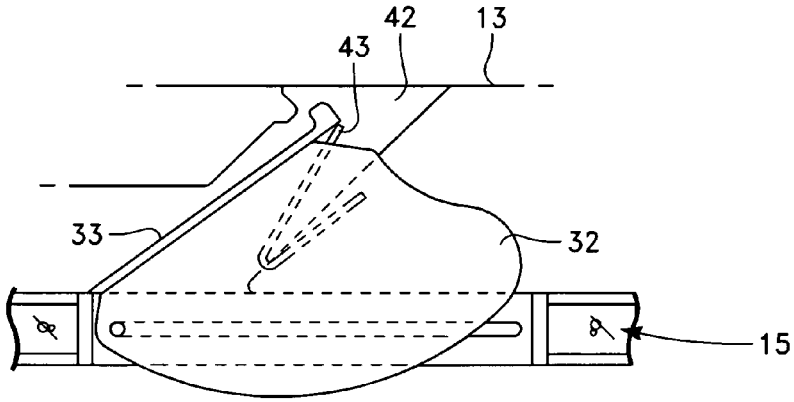
FIG. 15 is similar to FIG. 14, but with the two halves of the disengageable board just after separation.
Figure 16:
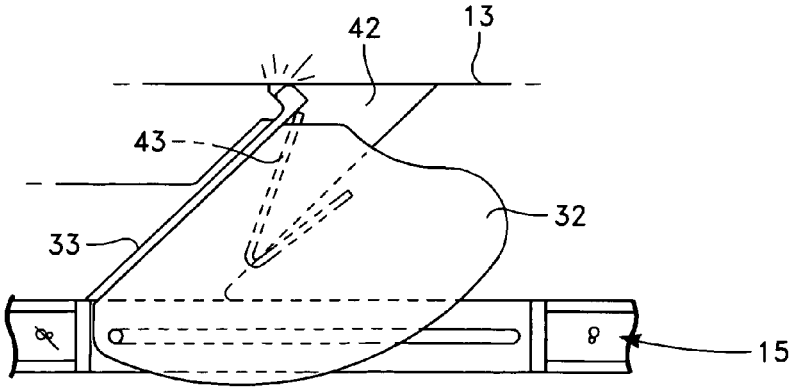
FIG. 16 is similar to FIG. 15, but with the board intact.

FIGS. 14-16 shows an alternate mechanism for the connection of the two boards, at different states of connection and disconnection. These views show how the fin 32 of the front board 15 gets tucked into the base board 13 when connected. In this embodiment, the base board 13 includes a channel 42 with a spring 43 that alternately receives and releases the front board 15.

Figure 19:
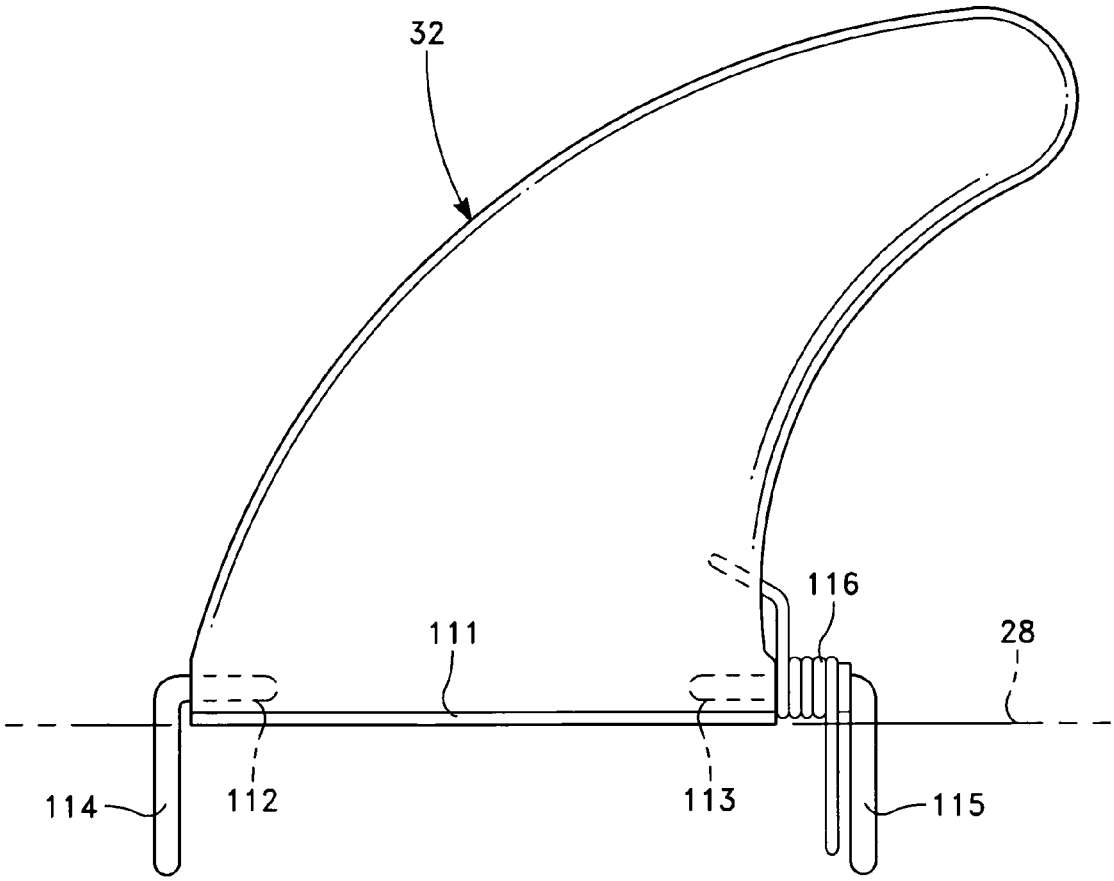
FIG. 19 is a side view of the alternate mechanism for the release of the fins on the short board.
Figure 20:
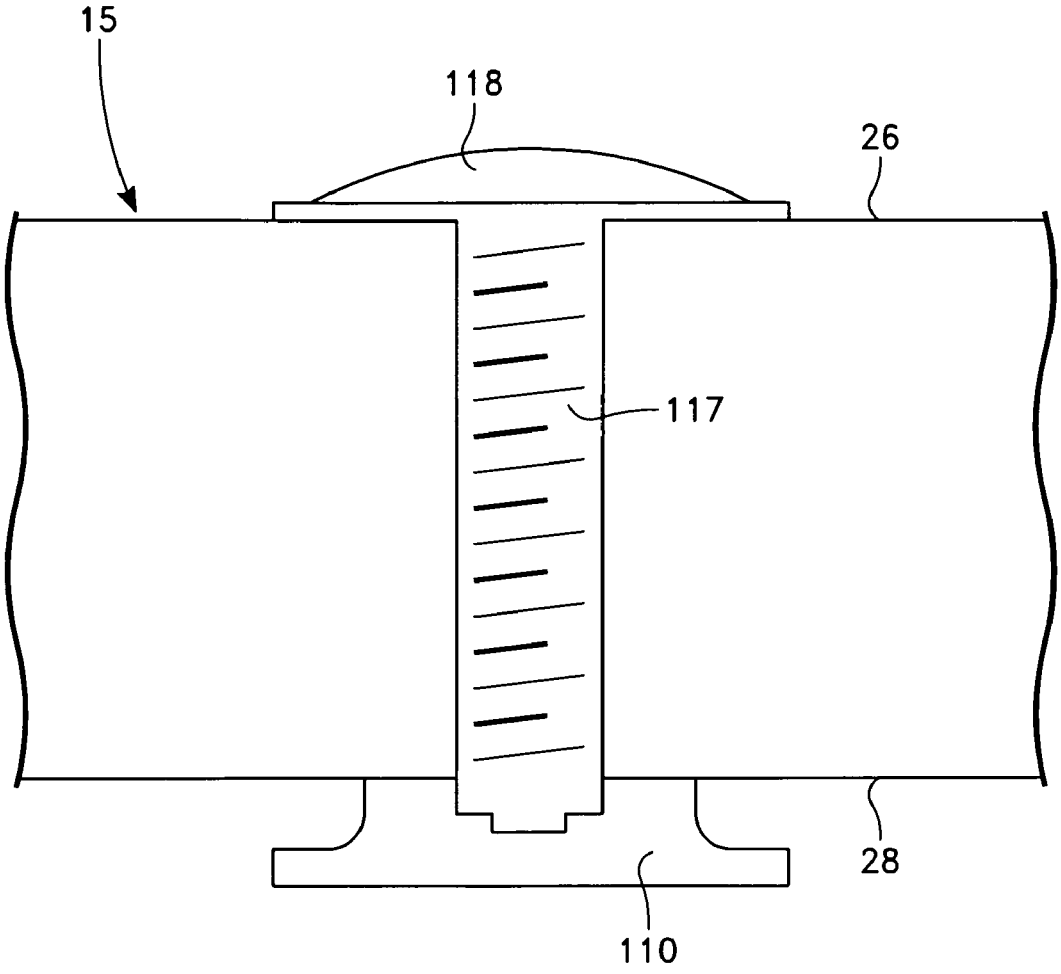
FIG. 20 is a cross sectional view of the release mechanism as shown in FIGS. 17-19.

FIGS. 17-20 show an alternate mechanism for the release of the fins 32 on the front board 15 after release from the base board 13. In this embodiment two fins 32 lay flush against the board 15 and are held in place by a movable stop 110. At the base 111 of the fins 32 are apertures 112, 113 through which securing pins 114, 115 are placed. Wrapped around one of the securing pins 115 is a spring 116. FIG. 20 shows a cross section wherein a catch mechanism 118 is attached to a threaded member 117 that cuts through the cross section of the board 15 and that is then attached to the movable stop 110.

Figure 17:
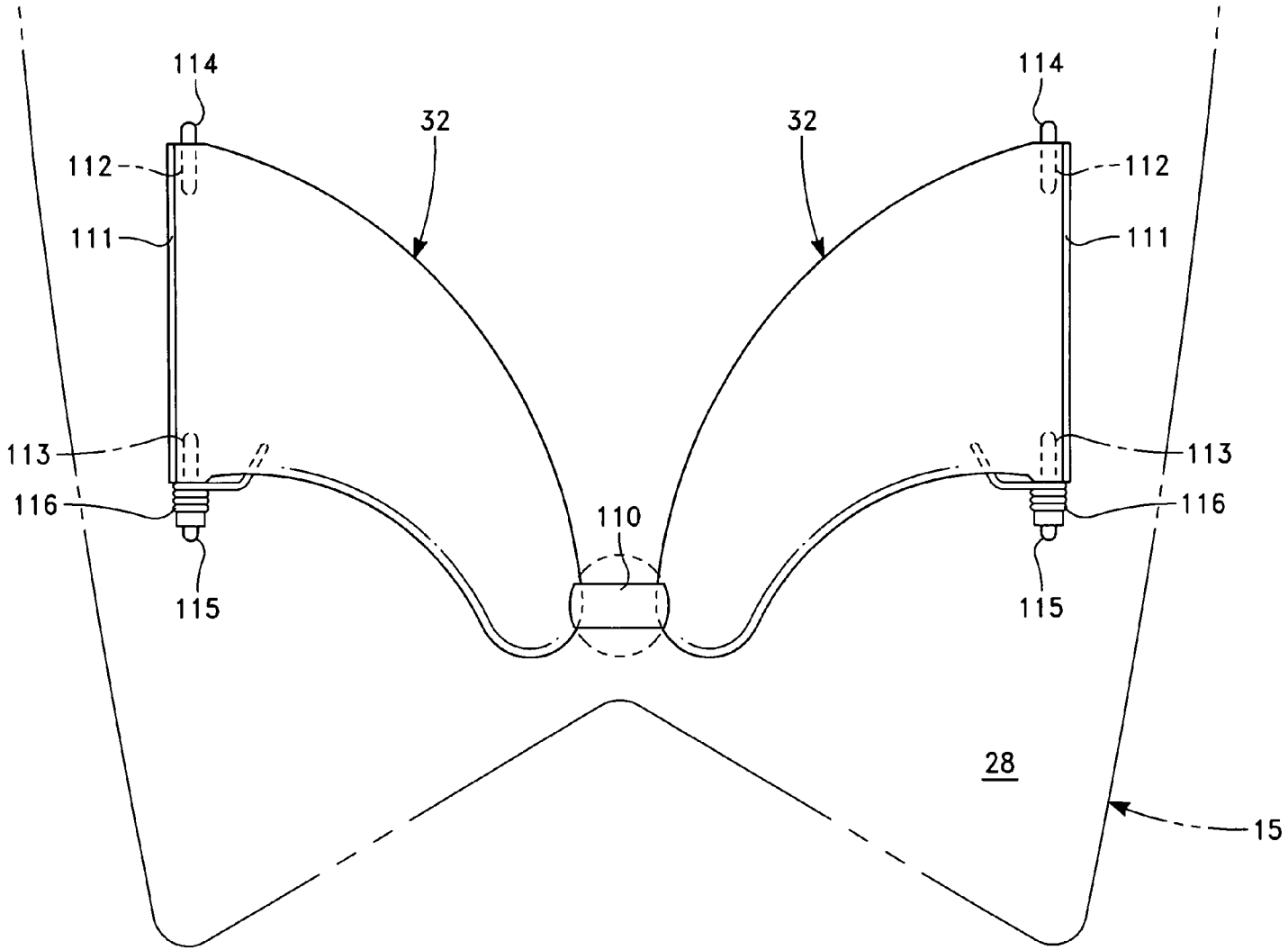
FIG. 17 is a top view of an alternate mechanism for the release of the fins on the short board.
Figure 18:
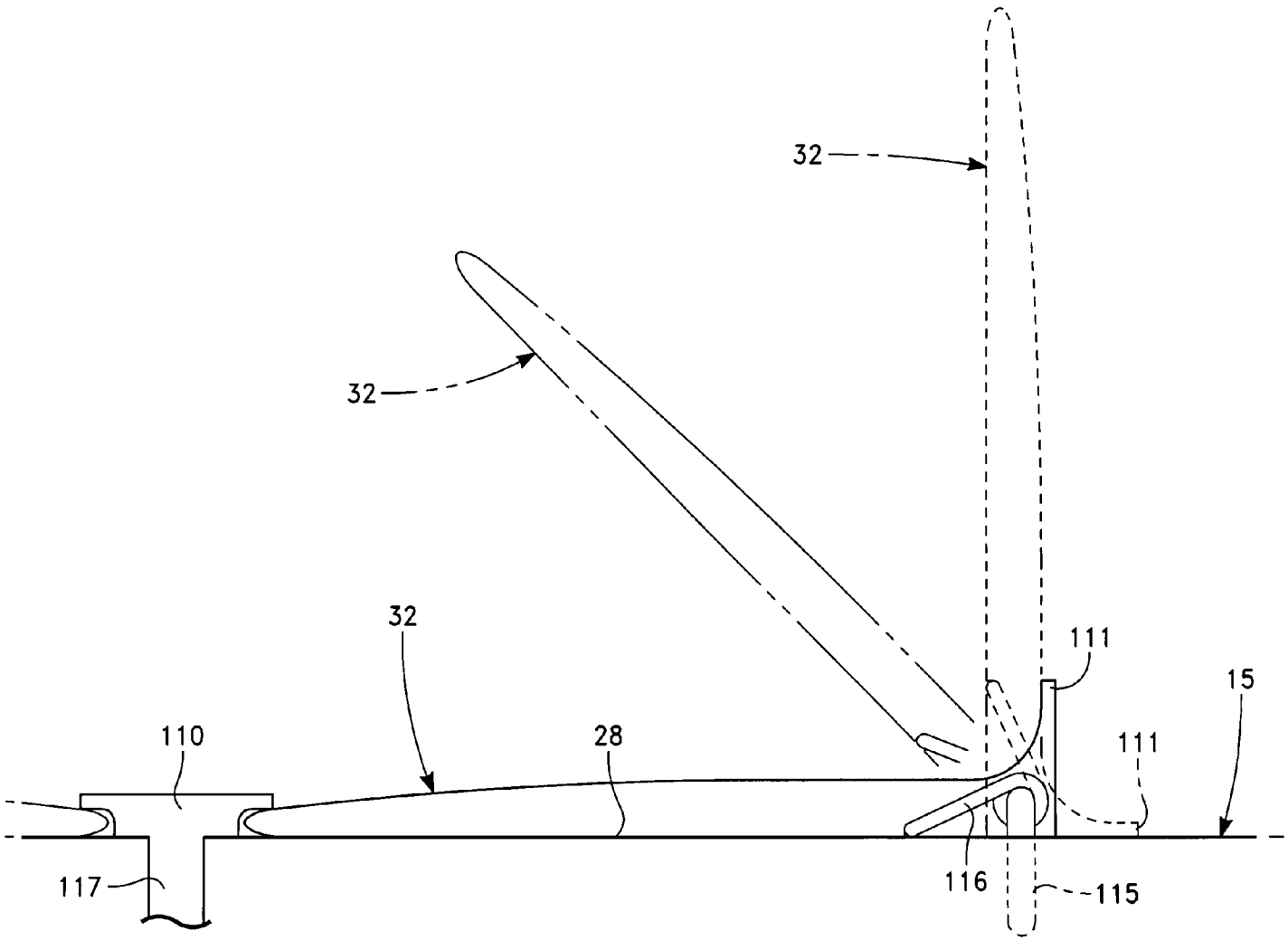
FIG. 18 is a side view of the alternate mechanism for the release of the fins on the short board.

When the rider applies pressure to the catch mechanism 118, the threaded member 117 rotates through the board 15 and to the movable stop 110 which then disengages the fins 32 from the flat orientation shown in FIG. 17 to the erect position shown in FIG. 19. The sequence from flat to erect is illustrated in FIG. 19.

When the rider is finished riding the short board 15, he or she simply replaces the fins 32 into the flat position, securing them with the movable stop 10, reconnects to the base board 13 and returns to the ocean to catch another wave.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

The invention claimed is:

1. A method for catching and riding waves comprising paddling a long board that can break apart in the water to provide a shorter board into the surf, said long board further comprising a base board having a top platform, two side rails, a tail, a bottom side, at least one fin on said bottom side, and a connecting portion at the opposite of said tail;

a front board that is releasably connected to said base at said connecting portion, said front board having a top platform, a nose, a tail, two side rails, a bottom side and at least one fin on said bottom side;

wherein said front board is connected to said base board at said connecting portion and wherein said front board is easily released from said base board through the application of pressure to said connecting portion;

turning said long board toward the shore and paddling with the wave until said board is moving toward the shore along said wave;

jumping to a standing position on said top platform of said base board;

moving to said top platform of said front board;

applying pressure to said connecting portion of said base board thereby releasing said front board from said base board; and continuing to ride said wave with said front board alone.

2. The method as defined in claim 1 wherein said long board is paddled into the surf with the user in a standing position and using a paddle.

3. The method as defined in claim 1 wherein said long board is paddled into the surf with the user in the prone position and using his arms.

4. The method according to claim 1 wherein said base board is made of foam.

5. The method according to claim 1 wherein said front board is made of polyurethane covered with layers of fiberglass cloth and polyester.

6. The method according to claim 1 wherein said front board is made of polyurethane covered with layers of fiberglass cloth and epoxy resin.

7. The method according to claim 1 wherein said front board is made of expanded polystyrene foam covered with layers of fiberglass cloth and polyester.

8. The method according to claim 1 wherein said front board is made of expanded polystyrene foam covered with layers of fiberglass cloth and epoxy resin.

9. The method according to claim 1 wherein said front board further comprises a means for securing a tether that has a proximate end attached to said front board and a distal end attached to the user's body.

* * * * *